US008514040B2

(12) United States Patent
Gruner

(10) Patent No.: US 8,514,040 B2
(45) Date of Patent: Aug. 20, 2013

(54) BI-STABLE ELECTROMAGNETIC RELAY WITH X-DRIVE MOTOR

(75) Inventor: Philipp Gruner, Petaluma, CA (US)

(73) Assignee: Clodi, L.L.C., Cotati, CA (US)

( * ) Notice: Subject to any disclaimer, the term of this patent is extended or adjusted under 35 U.S.C. 154(b) by 272 days.

(21) Appl. No.: 12/931,820

(22) Filed: Feb. 11, 2011

(65) Prior Publication Data

US 2012/0206222 A1 Aug. 16, 2012

(51) Int. Cl.
*H01H 67/02* (2006.01)

(52) U.S. Cl.
USPC ..... 335/177; 335/125

(58) Field of Classification Search
USPC ..... 335/78–86
See application file for complete search history.

(56) References Cited

U.S. PATENT DOCUMENTS

| | | | | | |
|---|---|---|---|---|---|
| 2,784,327 | A | * | 3/1957 | Drescher | 310/36 |
| 2,832,902 | A | * | 4/1958 | Drescher | 310/15 |
| 2,904,707 | A | * | 9/1959 | Drescher | 310/15 |
| 3,582,695 | A | * | 6/1971 | Wannamaker | 310/15 |
| 3,993,971 | A | * | 11/1976 | Ono et al. | 335/202 |
| 4,539,540 | A | * | 9/1985 | Kimpel et al. | 335/125 |
| 4,625,191 | A | * | 11/1986 | Oberndorfer et al. | 335/78 |
| 4,713,638 | A | * | 12/1987 | Kamo et al. | 335/79 |
| 4,743,877 | A | * | 5/1988 | Oberndorfer et al. | 335/128 |
| 4,881,054 | A | * | 11/1989 | Polgar | 335/230 |
| 5,227,750 | A | * | 7/1993 | Connell et al. | 335/86 |
| 5,359,305 | A | * | 10/1994 | Kitamura et al. | 335/78 |
| 5,568,108 | A | | 10/1996 | Kirsch | |
| 5,910,759 | A | | 6/1999 | Passow | |
| 5,933,065 | A | | 8/1999 | Duchemin | |
| 5,994,987 | A | | 11/1999 | Passow | |
| 6,020,801 | A | | 2/2000 | Passow | |
| 6,025,766 | A | | 2/2000 | Passow | |
| 6,046,660 | A | | 4/2000 | Gruner | |
| 6,046,661 | A | | 4/2000 | Reger et al. | |
| 6,246,306 | B1 | | 6/2001 | Gruner | |
| 6,252,478 | B1 | | 6/2001 | Gruner | |
| 6,292,075 | B1 | | 9/2001 | Cornell et al. | |
| 6,320,485 | B1 | | 11/2001 | Gruner | |
| 6,426,689 | B1 | | 7/2002 | Nakagawa et al. | |
| 6,563,409 | B2 | | 5/2003 | Gruner | |
| 6,661,319 | B2 | | 12/2003 | Schmelz | |
| 6,940,375 | B2 | | 9/2005 | Sanada et al. | |
| 6,949,997 | B2 | | 9/2005 | Bergh et al. | |
| 7,504,915 | B2 | * | 3/2009 | Takayama et al. | 335/78 |
| 7,710,227 | B2 | * | 5/2010 | Schmidt | 335/302 |
| 2006/0279384 | A1 | | 12/2006 | Takayama et al. | |

* cited by examiner

*Primary Examiner* — Elvin G Enad
*Assistant Examiner* — Lisa Homza
(74) *Attorney, Agent, or Firm* — Meroni & Meroni, P.C.; Charles F. Meroni, Jr.; Christopher J. Scott

(57) ABSTRACT

An electromagnetic relay assembly comprises a rotatable electromagnetic coil assembly, first and second pairs of opposed permanent magnets, and a switch assembly. The coil assembly comprises a coil, a core, and a rotatable coil housing. The coil is wound around the core. The core comprises opposed core termini, and the coil housing has an axis of rotation orthogonal to the coil axis. The magnet pairs fixedly positioned adjacent the core termini such that the core termini are respectively displacable intermediate the magnet pairs. The coil operates to create a magnetic field directable through the core for imparting coil housing rotation about the axis of rotation via attraction to the positioned/anchored magnets. The core termini displace linkage arms, and the linkage arms actuate contact-spring assemblies of the switch assembly intermediate open and closed positions.

25 Claims, 13 Drawing Sheets

BI-STABLE ELECTROMAGNETIC RELAY WITH X-DRIVE MOTOR

BACKGROUND OF THE INVENTION

1. Field of the Invention

The disclosed invention generally relates to an electromagnetic relay assembly incorporating a rotatable coil-core assembly. More particularly, the disclosed invention relates to an electromagnetic relay assembly having a magnetically actuable coil assembly rotatable about an axis of rotation extending orthogonally relative to the coil assembly axis.

2. Brief Description of the Prior Art

Generally, the function of an electromagnetic relay is to use a small amount of power in the electromagnet to move an armature that is able to switch a much larger amount of power. By way of example, the relay designer may want the electromagnet to energize using 5 volts and 50 milliamps (250 milliwatts), while the armature can support 120 volts at 2 amps (240 watts). Relays are quite common in home appliances where there is an electronic control turning on (or off) some application device such as a motor or a light. Several exemplary electromagnetic relay assemblies reflective of the state of the art and disclosed in United States patents are briefly described hereinafter.

U.S. Pat. No. 6,046,660 ('660 patent), which issued to Gruner, discloses a Latching Magnetic Relay assembly with a Linear Motor. The '660 patent describes a latching magnetic relay capable of transferring currents of greater than 100 amps for use in regulating the transfer of electricity or in other applications requiring the switching of currents of greater than 100 amps. A relay motor assembly has an elongated coil bobbin with an axially extending cavity therein. An excitation coil is wound around the bobbin. A generally U shaped ferromagnetic frame has a core section disposed in and extending through the axially extending cavity in the elongated coil bobbin.

Two contact sections extend generally perpendicularly to the core section and rises above the motor assembly. An actuator assembly is magnetically coupled to the relay motor assembly. The actuator assembly is comprised of an actuator frame operatively coupled to a first and a second generally U-shaped ferromagnetic pole pieces, and a permanent magnet. A contact bridge made of a sheet of conductive material copper is operatively coupled to the actuator assembly.

U.S. Pat. No. 6,246,306 ('306 patent), which issued to Gruner, discloses an Electromagnetic Relay with Pressure Spring. The '306 patent teaches an electromagnetic relay having a motor assembly with a bobbin secured to a housing. A core is adjacently connected below the bobbin except for a core end, which extends from the bobbin. An armature end magnetically engages the core end when the coil is energized. An actuator engages the armature and a plurality of center contact spring assemblies. The center contact spring assembly is comprised of a center contact spring which is not pre bent and is ultrasonically welded onto a center contact terminal.

A normally open spring is positioned relatively parallel to a center contact spring. The normally open spring is ultrasonically welded onto a normally open terminal to form a normally open outer contact spring assembly. A normally closed outer contact spring is vertically positioned with respect to the center contact spring so that the normally closed outer contact spring assembly is in contact with the center contact spring assembly, when the center contact spring is not being acted upon by the actuator. The normally closed spring is ultrasonically welded onto a normally closed terminal to form a normally closed assembly. A pressure spring pressures the center contact spring above the actuator when the actuator is not in use.

U.S. Pat. No. 6,252,478 ('478 patent), which issued to Gruner, discloses an Electromagnetic Relay. The '478 patent describes an electromagnetic relay having a motor assembly with a bobbin secured to a frame. A core is disposed within the bobbin except for a core end which extends from the bobbin. An armature end magnetically engages the core end when the coil is energized. An actuator engages the armature and a plurality of movable blade assemblies. The movable blade assembly is comprised of a movable blade ultrasonically welded onto a center contact terminal.

A normally open blade is positioned relatively parallel to a movable blade. The normally open blade is ultrasonically welded onto a normally open terminal to form a normally open contact assembly. A normally closed contact assembly comprised of a third contact rivet and a normally closed terminal. A normally closed contact assembly is vertically positioned with respect to the movable blade so that the normally closed contact assembly is in contact with the movable blade assembly when the movable blade is not being acted upon by the actuator.

U.S. Pat. No. 6,320,485 ('485 patent), which issued to Gruner, discloses an Electromagnetic Relay Assembly with a Linear Motor. The '485 patent describes an electromagnetic relay capable of transferring currents of greater than 100 amps for use in regulating the transfer of electricity or in other applications requiring the switching of currents of greater than 100 amps. A relay motor assembly has an elongated coil bobbin with an axially extending cavity therein. An excitation coil is wound around the bobbin. A generally U shaped ferromagnetic frame has a core section disposed in and extending through the axially extending cavity in the elongated coil bobbin.

Two contact sections extend generally perpendicularly to the core section and rises above the motor assembly. An actuator assembly is magnetically coupled to the relay motor assembly. The actuator assembly is comprised of an actuator frame operatively coupled to a first and a second generally U-shaped ferromagnetic pole pieces, and a permanent magnet. A contact bridge made of a sheet of conductive material copper is operatively coupled to the actuator assembly.

U.S. Pat. No. 6,563,409 ('409 patent), which issued to Gruner, discloses a Latching Magnetic Relay Assembly. The '409 patent describes a latching magnetic relay assembly comprising a relay motor with a first coil bobbin having a first excitation coil wound therearound and a second coil bobbin having a second excitation coil wound therearound, both said first excitation coil and said second excitation coil being identical, said first excitation coil being electrically insulated from said second excitation coil; an actuator assembly magnetically coupled to both said relay motor, said actuator assembly having a first end and a second end; and one or two groups of contact bridge assemblies, each of said group of contact bridge assemblies comprising a contact bridge and a spring.

Other patent disclosures of particular interest are U.S. Pat. No. 4,743,877, which issued to Oberndorfer et al.; U.S. Pat. No. 5,568,108, which issued to Kirsch; U.S. Pat. Nos. 5,910,759; 5,994,987; 6,020,801; 6,025,766, all of which issued to Passow; U.S. Pat. No. 5,933,065, which issued to Duchemin; U.S. Pat. No. 6,046,661, which issued to Reger et al.; U.S. Pat. No. 6,292,075, which issued to Connell et al.; U.S. Pat. No. 6,426,689, which issued to Nakagawa et al.; U.S. Pat. Nos. 6,661,319 and 6,788,176, which issued to Schmelz; U.S. Pat. No. 6,949,997, which issued to Bergh et al.; U.S. Pat. No.

6,940,375, which issued to Sanada et al.; and U.S. Patent Application Publication No. 2006/0279384, which was authored by Takayama et al.

The Schmelz, Duchemin, and certain of the Gruner disclosures were particularly relevant to the subject matter as described in U.S. Pat. No. 7,659,800 (the '800 patent) and U.S. Pat. No. 7,710,224 (the '224 patent), which issued to Gruner et al. The '800 and '224 patents describe electromagnetic relays essentially comprising a coil assembly, a rotor or bridge assembly, and a switch assembly. The coil assembly comprises a coil and a C-shaped core. The coil is wound round a coil axis extending through the core. The core comprises core termini parallel to the coil axis. The bridge assembly comprises a H-shaped bridge and an actuator.

The bridge comprises medial, lateral, and transverse field pathways. The actuator extends laterally from the lateral field pathway. The core termini are coplanar with the axis of rotation and received intermediate the medial and lateral field pathways. The actuator is cooperable with the switch assembly. The coil creates a magnetic field directable through the bridge assembly via the core termini for imparting bridge rotation about the axis of rotation. The bridge rotation displaces the actuator for opening and closing the switch assembly.

Notably, the Kirsch U.S. Pat. No. 5,568,108; the Reger et al. U.S. Pat. No. 6,046,661; the Nakagawa et al. U.S. Pat. No. 6,426,689; the Schmelz U.S. Pat. Nos. 6,661,319 and 6,788,176 and the Gruner et al. '800 and 224 patents teach or describe armature assemblies having an H-shaped portion pivotable about a pivot axis of rotation, which H-shaped portion comprises or is otherwise attached to an elongated actuator arm extending from the H-shaped portion.

It is noted that an inherent problem with conventional electromagnetic relays incorporating a coil assembly and an armature of the foregoing type(s) is that they are quite susceptible to magnetic tampering. This is primarily because the rotating armature houses a permanent magnet. These permanent magnets react to the magnetic field generated by the coil and are either repelled or attracted, thereby creating a mechanical motion to open and/or close the contacts.

This leaves the relay(s) vulnerable to tampering by using a very large magnet (i.e. positioning a large conflicting magnetic field) external to the relay. Since the permanent magnets are housed in a rotating plastic casing, this means t will only hold its state as long as no other magnetic or mechanical force is exerted to the relay which is larger than the magnetic holding force of the permanent magnets.

It is noted that certain international standards require that the relay hold its state in either the open or closed position when a magnetic field measuring at least 5000 Gauss is brought within 40 millimeters of the relay. During this test, many relays cannot operate due to the conflicting 5000 Gauss magnetic field. This type of tampering is common in developing countries or in lower income areas to turn the electricity meter back on after the utility company has remotely shut it off.

The prior art thus perceives a need for an electromagnetic relay that is resistant to magnetic tampering whereby the permanent magnets are fixed or anchored and the coil assembly itself rotates with minimized displacements so as to intensify the operative magnetic field otherwise inherent to the same size magnets.

SUMMARY OF THE INVENTION

It is thus on object of the present invention to provide a so-called bi-stable electromagnetic relay assembly in which the permanent magnets are fixed inside the plastics and the coil itself rotates, unlike conventional relays incorporating fixed coils and moving permanent magnets cooperably associated with rotating armatures. To achieve this and other readily apparent objectives, the present invention essentially provides an electromagnetic relay assembly for selectively enabling current to pass through switch termini, which relay comprises a rotatable electromagnetic coil assembly, first and second pairs of opposed permanent magnets, and a switch assembly.

The rotatable coil assembly comprises a current-conductive coil, an axially extending coil core, and a rotatable coil housing. The coil is wound around the core, which core is collinear or parallel with the axis of the coil. The coil comprises electromagnet-driving termini, the core comprises opposed core termini, and the coil housing has a housing axis of rotation orthogonal to the coil axis.

The first and second pairs of opposed permanent magnets are respectively and fixedly positioned adjacent the core termini such that the core termini are respectively displacable intermediate the pairs of magnets. The switch assembly comprises first and second linkage arms, and first and second spring arms. The linkage arms interconnect the core termini and spring arms. The spring arms each comprise opposed pairs of contacts and a switch terminal.

The coil operates to create a magnetic field directable through the core for imparting coil housing rotation about the housing axis of rotation via attraction to the positioned/anchored permanent magnets. The core termini displace linkage arms, and the linkage arms actuate the spring arms intermediate an open switch assembly position and a closed switch assembly position, the latter of which enables current to pass through the switch assembly via the contacts and the switch termini.

Certain peripheral features of the essential electromagnetic relay assembly include, for example, certain spring means for damping contact vibration intermediate the contacts when switching from the open position to the closed position. In this regard, it is contemplated that the spring arms each may preferably comprise first and second spaced spring sections cooperable with the linkage arms and laterally spaced from the contacts so as to maximize the damping effect when switching from the open to closed switch assembly positions.

In this last regard, it is noted that a major problem for all electro-mechanical switchgear is the contact bounce when closing into an electric load. To overcome this, many have added additional leaf or coil springs to buffer the bounce of the contacts. The present invention takes advantage of a simple stamping process which enables the incorporation of an integrated bounce reduction spring on both sides of the contact site rather than just one.

While the loose end of a spring is the most likely place to open when operating the relay, it can still occur that the contacts open even if the loose end of the spring is set to the closed position. To overcome this, an additional stamping procedure has been incorporated into the present invention so as to apply contact pressure both the left and right side of the contact, ensuring equal contact pressure and making sure that the contacts stay closed when the relay is operated.

Other objects of the present invention, as well as particular features, elements, and advantages thereof, will be elucidated or become apparent from, the following description and the accompanying drawing figures.

BRIEF DESCRIPTION OF THE DRAWINGS

Other features of my invention will become more evident from a consideration of the following brief description of patent drawings.

DETAILED DESCRIPTION OF THE PREFERRED EMBODIMENT

Figure 1:
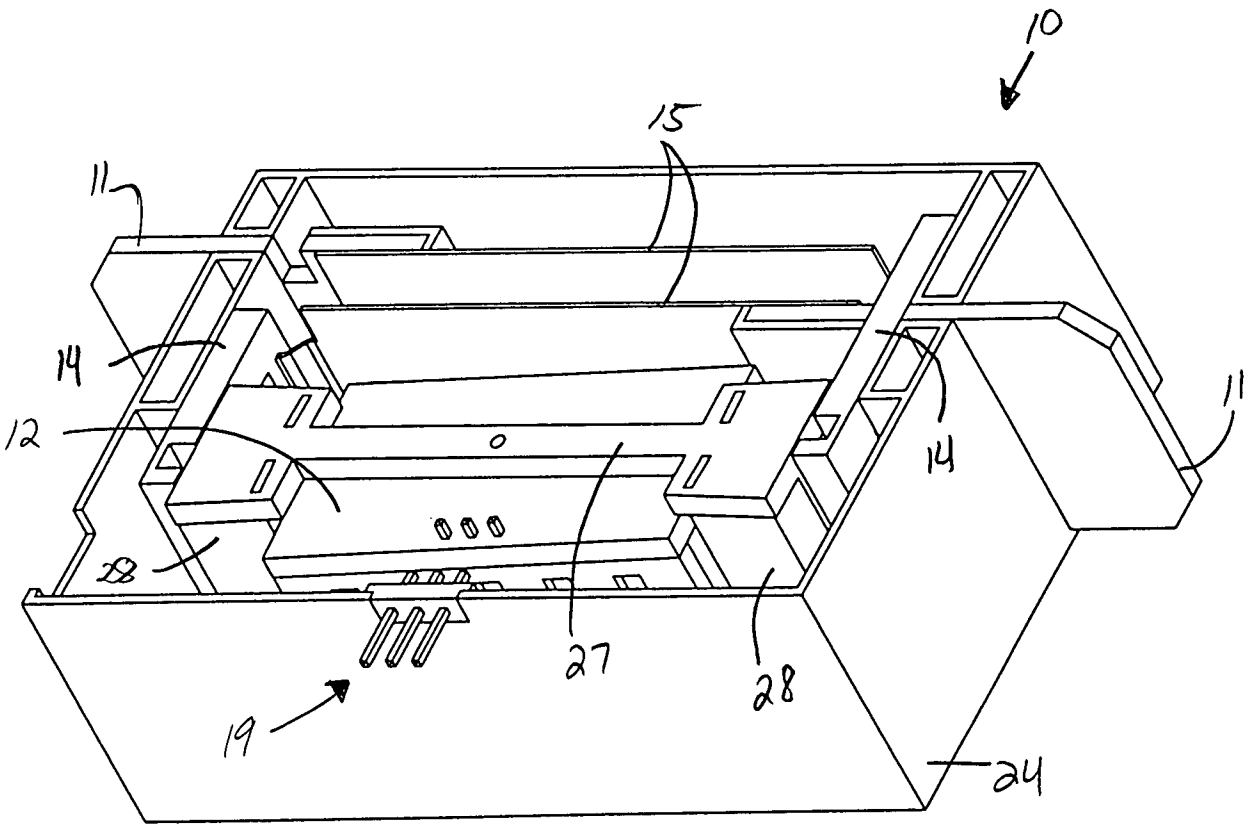
FIG. 1 is top perspective view of an assembled and preferred (exemplary single-pole) relay assembly according to the present invention with relay housing cover removed to show internal components.
Figure 2:
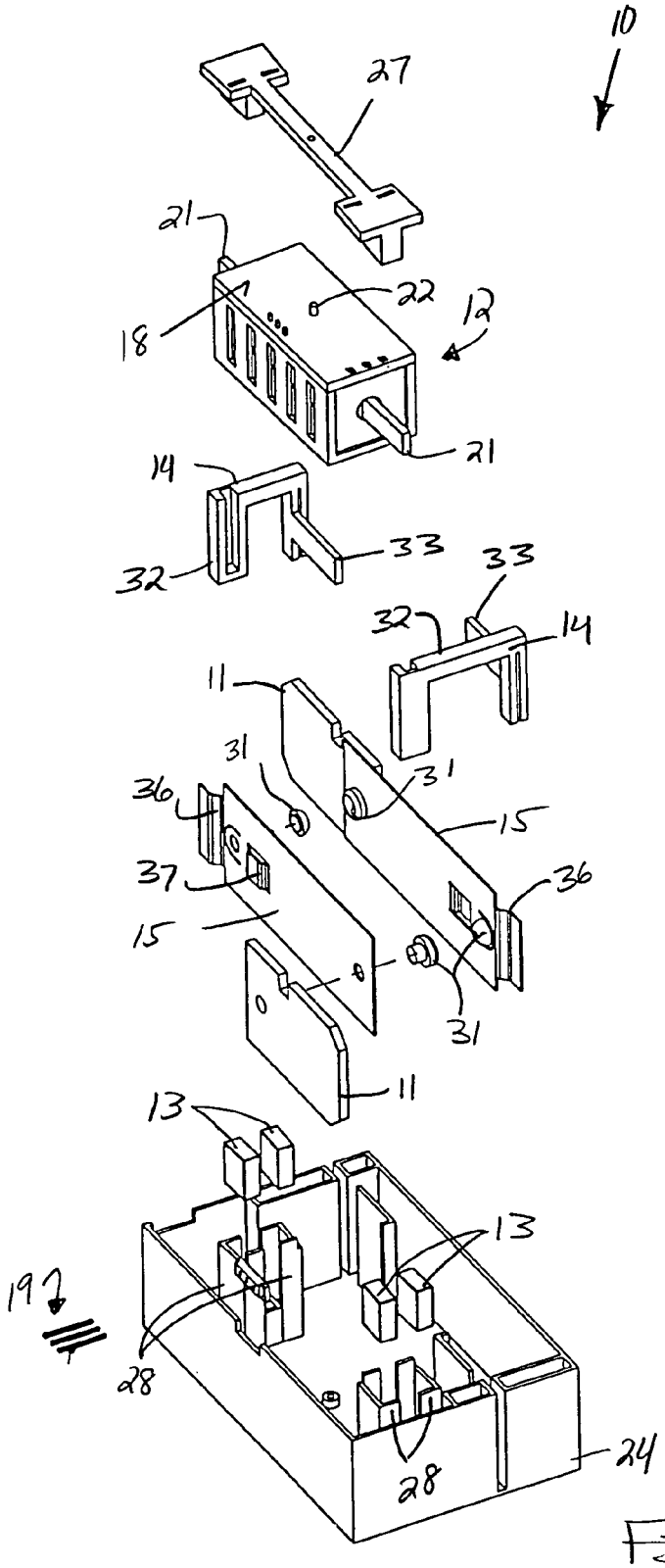
FIG. 2 is an exploded top perspective view of the preferred relay assembly according to the present invention showing from top to bottom, a bracket structure, an assembled coil assembly, linkage structures, contact-spring assemblies, permanent magnets, and the relay bottom casing.
Figure 3:
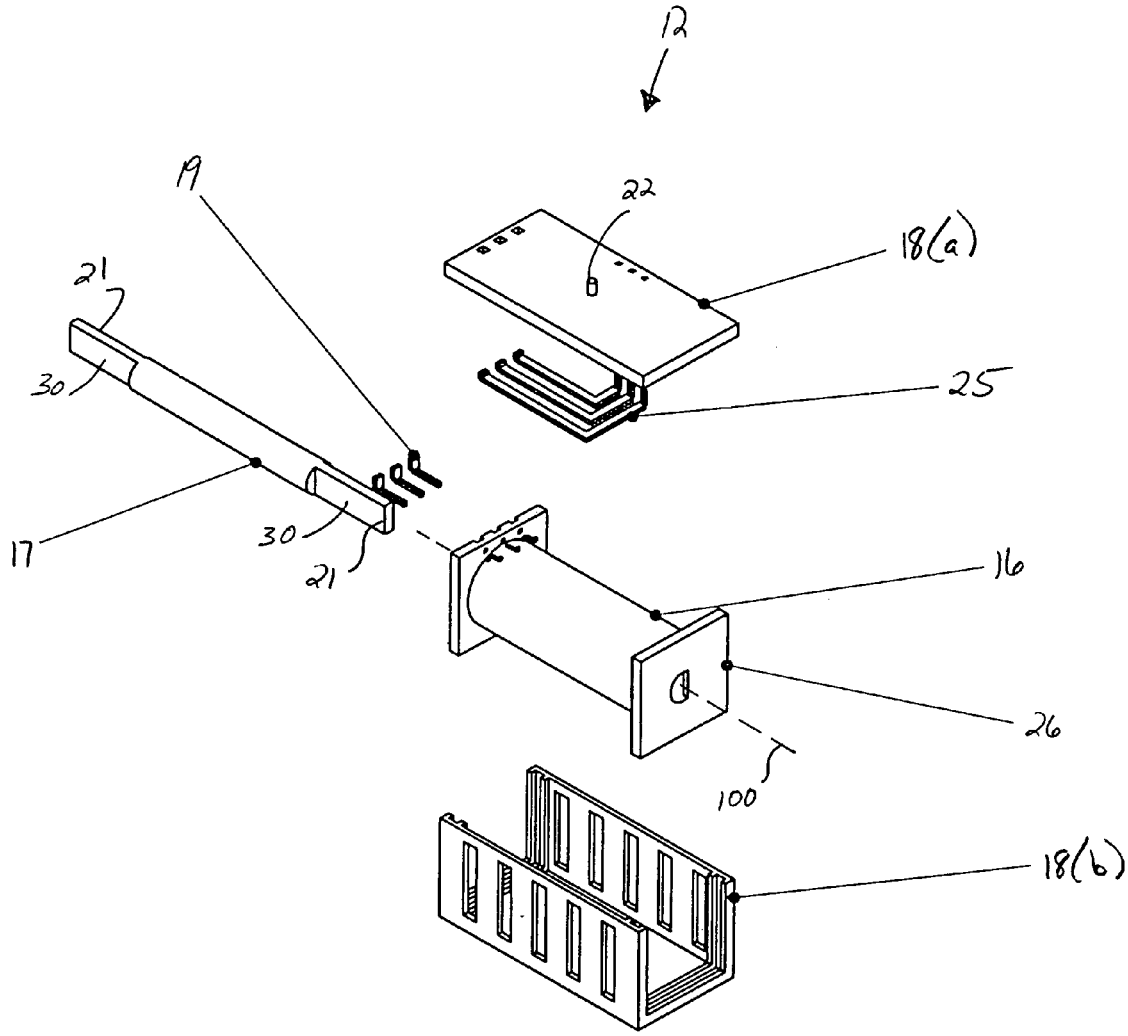
FIG. 3 is an exploded top perspective view of the coil assembly according to the present invention.
Figure 4:
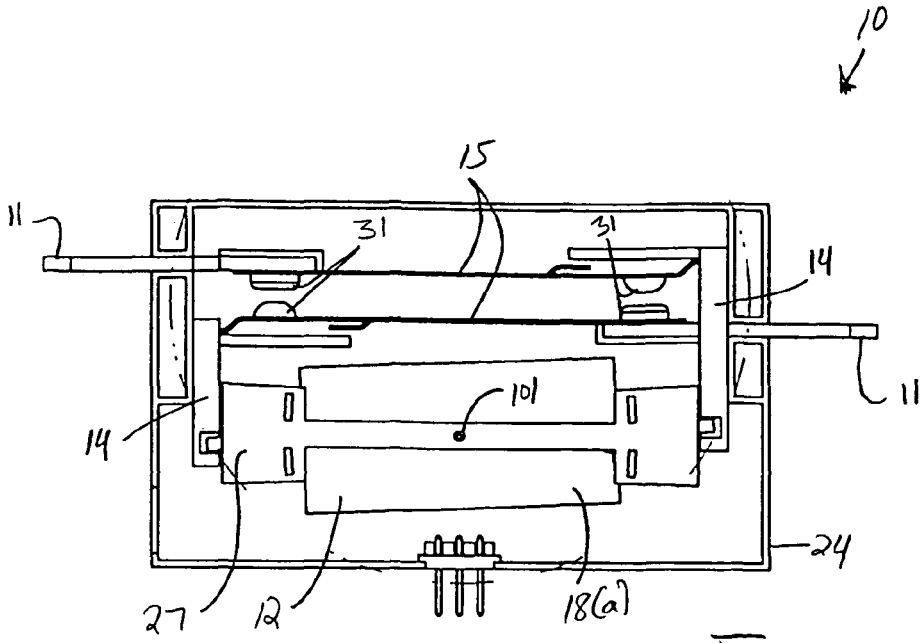
FIG. 4 is top plan view of the assembled and preferred relay assembly according to the present invention with relay housing cover removed to show internal components in an open switch assembly position.
Figure 5:
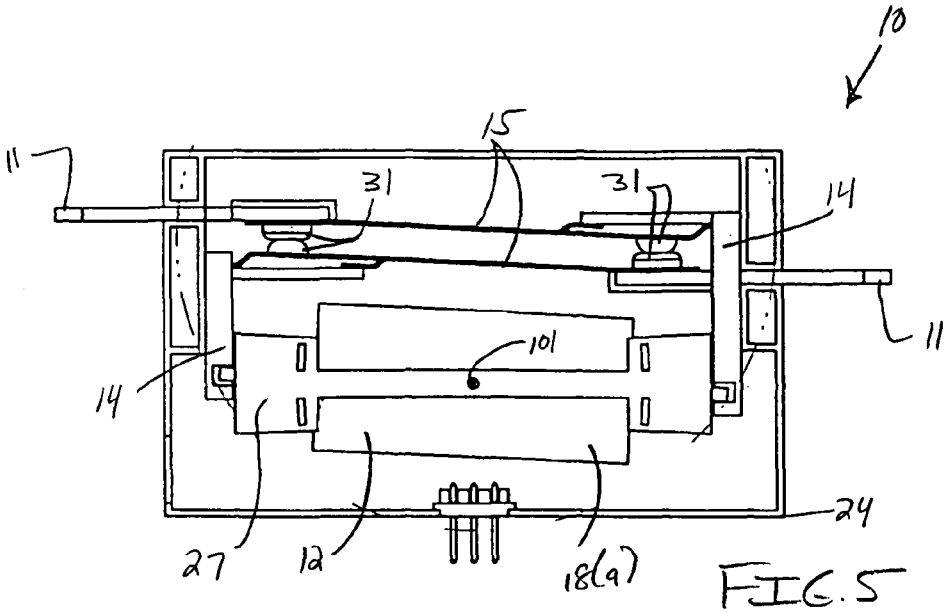
FIG. 5 is top plan view of the assembled and preferred relay assembly according to the present invention with relay housing cover removed to show internal components in a closed switch assembly position.
Figure 6:
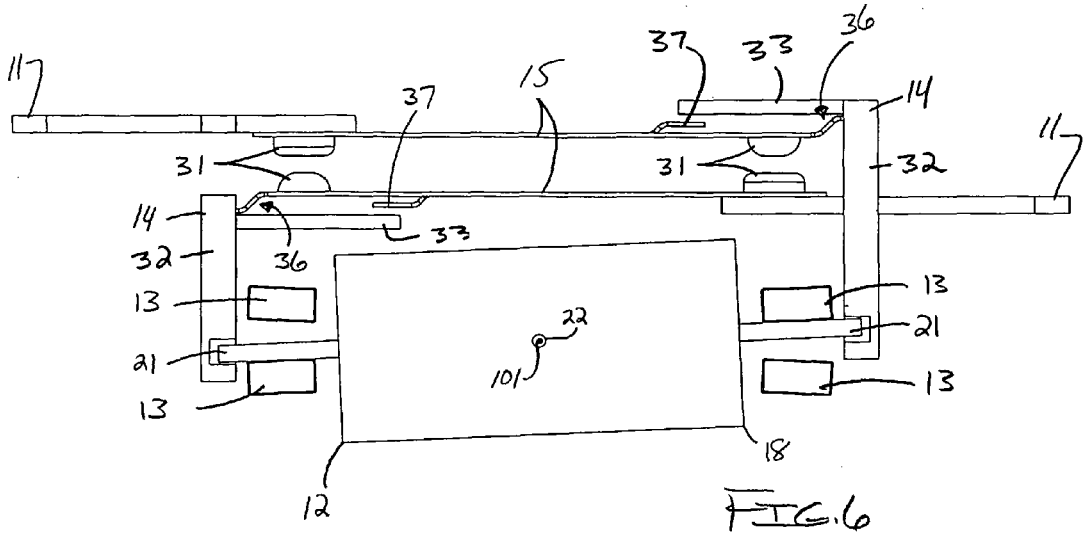
FIG. 6 is an enlarged plan view of the rotatable coil assembly (positioned intermediate fixed permanent magnet pairs) and contact-spring assemblies in the open switch assembly position.
Figure 7:
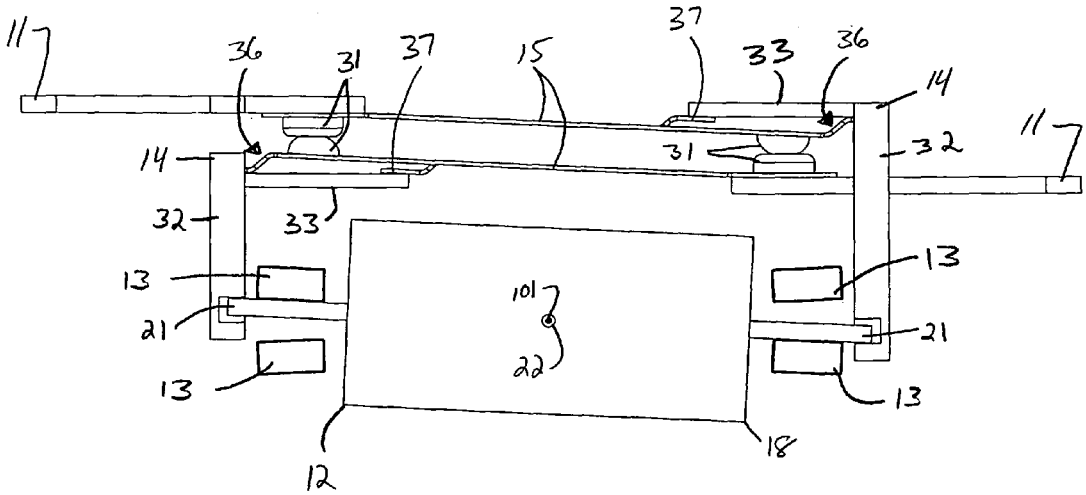
FIG. 7 is an enlarged plan view of the rotatable coil assembly (positioned intermediate fixed permanent magnet pairs) and contact-spring assemblies in the closed switch assembly position.

Referring now to the drawings, the preferred embodiment of the present invention concerns a so-called bi-stable electromagnetic relay (with X-drive motor) assembly 10 as generally illustrated and referenced in FIGS. 1, 2, 4, and 5. Assembly 10 is believed to teach the basic structural concepts supporting the present invention, which basic structural concepts may be applied to either single pole assemblies as generally depicted and supported by assembly 10, or multiple pole assemblies. In this last regard, an exemplary four-pole assembly 20 is generally illustrated and referenced in FIGS. 16-19.

The electromagnetic relay assembly 10 essentially functions to selectively enable current to pass through switch termini 11. The electromagnetic relay assembly 10 preferably comprises an electromagnetic coil assembly 12, first and second pairs of opposed permanent magnets 13, and a switch assembly comprising various components, including first and second linkage arms 14 (comprising one or more L-shaped portion(s)), and first and second spring arms 15, which arms 15 are in electrical communication with, or otherwise (conductively) fastened extensions of the switch termini 11.

The coil assembly 12 may preferably be thought to comprise a current-conductive coil 16 (with spool assembly 26), a coil core 17, and a coil housing 18 (comprising a coil lid 18(*a*) (outfitted with coil lid conductor(s) 25) and a coil base or coil box 18(*b*)). The coil 16 is wound around the core 17, which core 17 is collinear with a coil axis as at 100. The coil 16 comprises electromagnet-driving termini as at 19, and the core 17 comprises (linearly) opposed core termini as at 21.

Notably, the coil housing 18 has a housing axis of rotation 101, which axis 101 extends orthogonally relative to the coil axis 100. The housing axis of rotation 101 extends through pin structures 22 formed in axial alignment on the coil lid 18(*a*) and the coil box 18(*b*) of the housing 18, which pin structures 22 are received in pin-receiving structures 23 formed in a bracket 27 and relay housing 24.

The first and second pairs of opposed permanent magnets 13 are respectively and fixedly obliquely positioned (via housing anchor structures 28) adjacent the core termini 21 such that the core termini 21 are respectively displacable intermediate the respective pairs of magnets 13. The opposed pairs of permanent magnets 13 each comprise substantially planar opposed magnet faces 29, which faces 29 extend in intersecting planes 102 thereby exhibiting an X-shaped planar configuration as at 103 in FIG. No. 20 generally defining the boundaries of movement of the core termini 21.

In this last regard, it will be noted that the core 17 has a thickness as at 104, and the magnets 13 are positioned (via anchor structures 28) accordingly so as to properly contact the core termini 21. In other words, the core 17 preferably comprises substantially planar opposed core faces as at 30 such that the core faces 30 and magnet faces 29 are similarly angled when contacting one another for maximizing contact surface area and enhancing current flow through the maximized contacting surface area intermediate the core 17 and permanent magnets 13.

It will be understood form a consideration of the drawings that the linkage arms 14 (or linkage arms 14(*a*) of the multi-pole embodiment) function to interconnect the core termini 21 and spring arms 15. The spring arms 15 each comprise (i.e. are in electrical communication with or otherwise conductively fastened to) opposed pairs of contacts 31 and a switch terminal as at 11. The opposed pairs of contacts 31 are juxtaposed adjacent one another such that when the switch assembly is in a closed position, the contacts 31 contact one another as generally depicted in FIGS. 5, 7, 11, and 19. Conversely, the open switch assembly position is generally and comparatively depicted in FIGS. 4, 6, 10, and 18.

Figure 8:
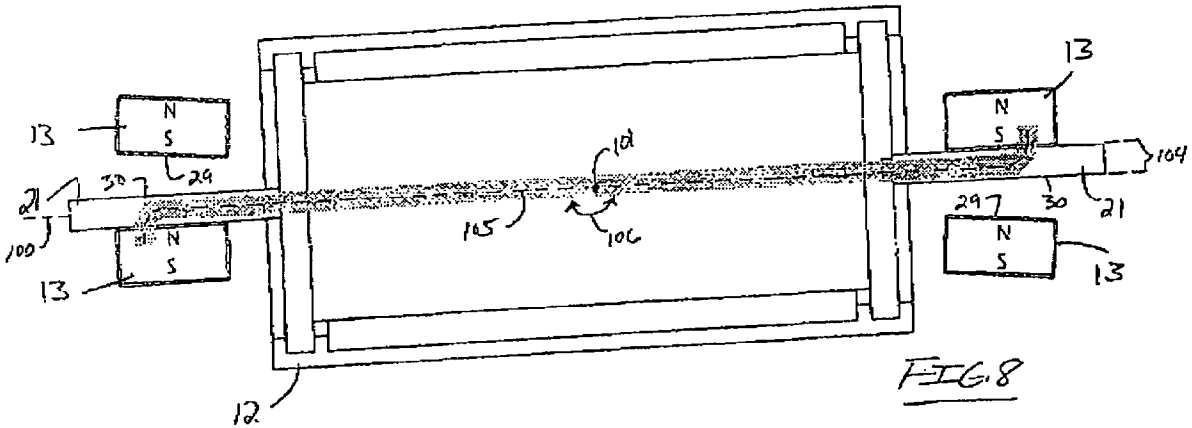
FIG. 8 is an enlarged diagrammatic type depiction of the rotatable coil assembly positioned intermediate fixed permanent magnet pairs in the open switch assembly position.
Figure 9:
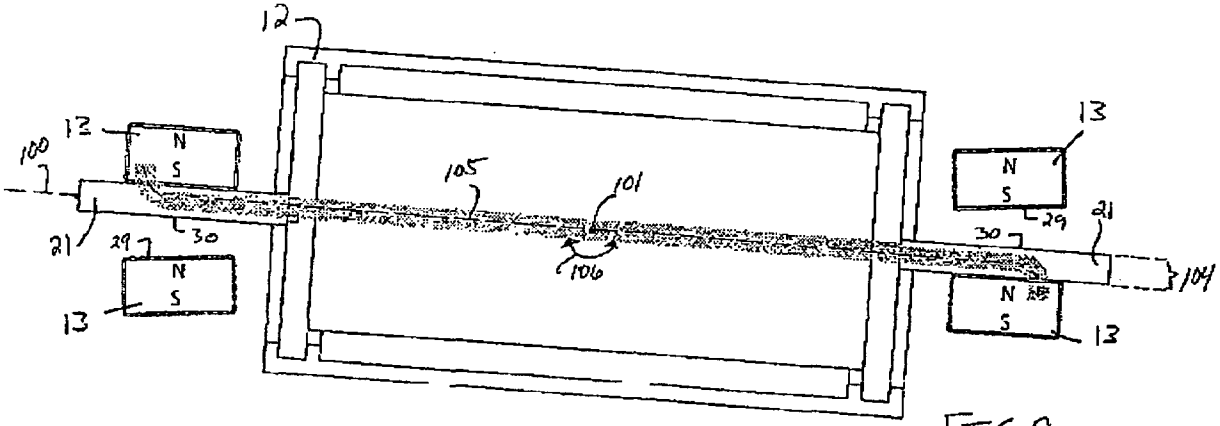
FIG. 9 is an enlarged diagrammatic type depiction of the rotatable coil assembly positioned intermediate fixed permanent magnet pairs in the closed switch assembly position.

The coil 16, when provided with current, functions to create a magnetic field as at 105, which magnetic field 15 is directable through the core 17 and cooperable with the magnets 13 (as generally pole aligned and depicted in FIGS. 8 and 9) for imparting coil housing (pivot type) rotation (as at 106) about the housing axis of rotation 101. The core termini 21 thus function to displace the linkage arms 14, which linkage arms 14, in turn actuate the spring arms 15 intermediate the open position and the closed position as previously referenced. The closed position enables current to pass through the switch assembly via the contacts 31 and the switch termini 11.

As earlier noted the linkage arms of assembly 10 are preferably L-shaped from a top plan view and thus comprise a first link portion as at 32 and a second link portion as at 33. With assembly 20, the linkage arms 14 comprise a first link portion as at 34 and a series of second link portions as at 35 (or a series of interconnected L-shaped structures). The second link portions 33 and 35 of each assembly 10/20 respectively extend toward one another orthogonal to the first link portions 32 and 34 of each assembly 10/20. The core termini 21 are connected to the first link portions 32 or 34 and the spring arms 15 extend substantially parallel to the second link portions 33 or 35 when in an open switch assembly position.

Figure 10:
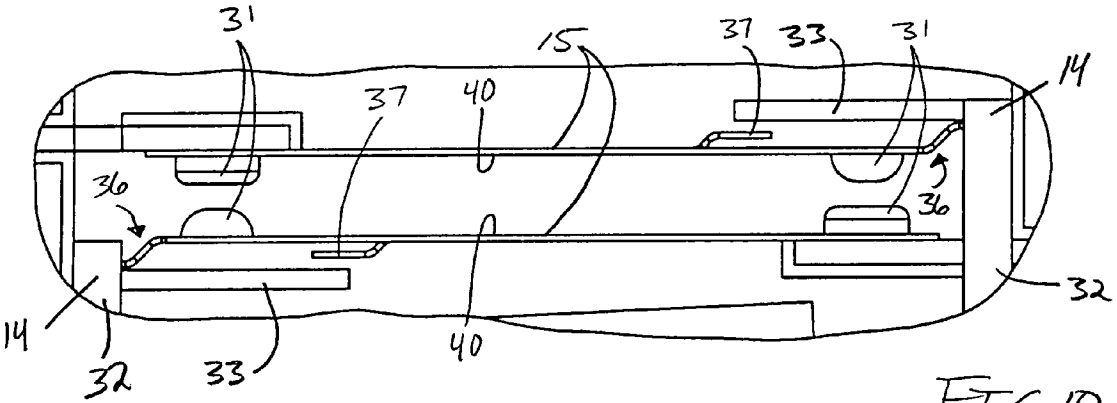
FIG. 10 is an enlarged depiction of the contact-spring assemblies in the open switch assembly position.
Figure 11:
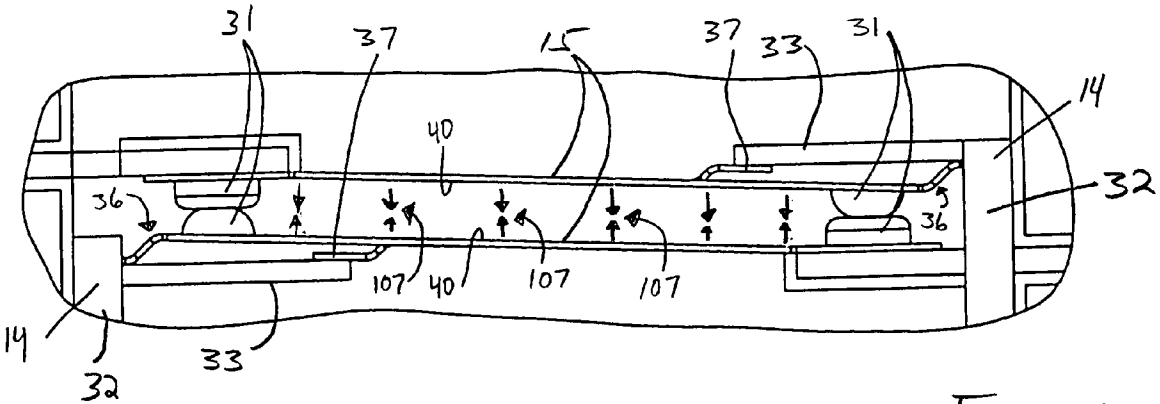
FIG. 11 is an enlarged depiction of the contact-spring assemblies in the closed switch assembly position.
Figure 12:
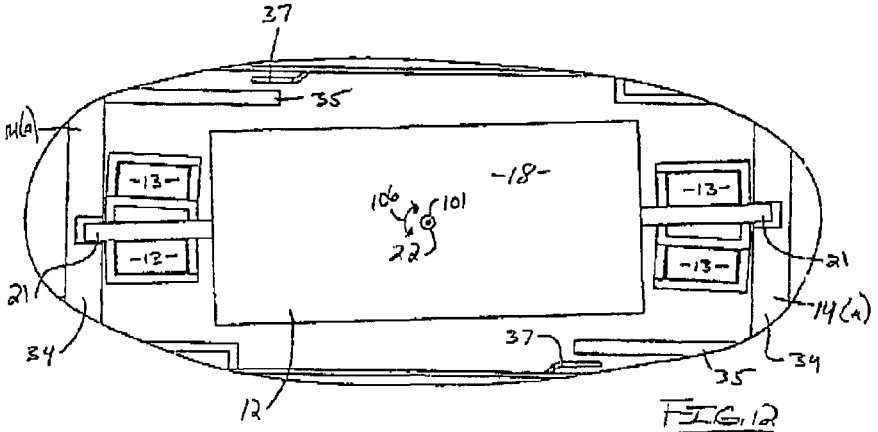
FIG. 12 is an enlarged plan view of the rotatable coil assembly of a multi-pole alternative embodiment according to the present invention showing the rotatable coil assembly in the open switch assembly position.
Figure 13:
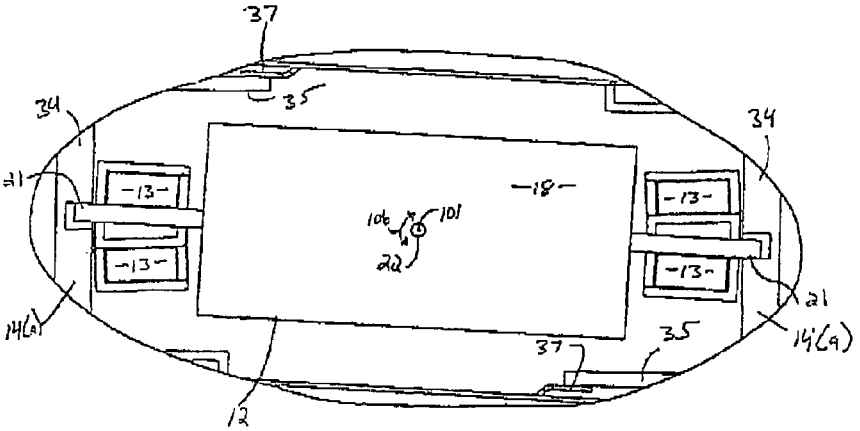
FIG. 13 is an enlarged plan view of the rotatable coil assembly of a multi-pole alternative embodiment according to the present invention showing the rotatable coil assembly in the closed switch assembly position.
Figure 14:
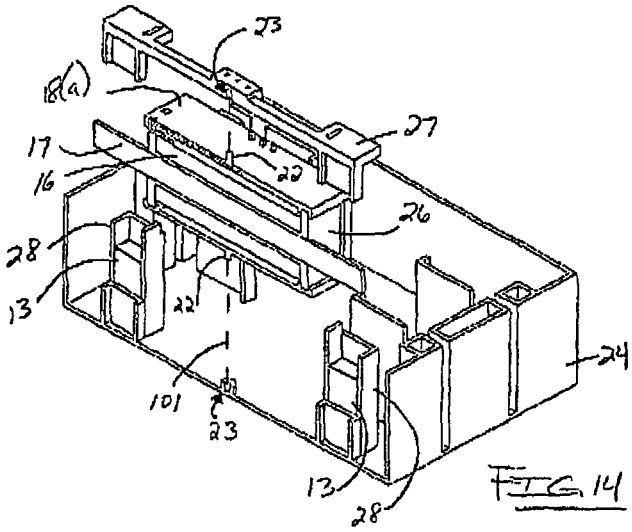
FIG. 14 is a fragmentary exploded top perspective view of the preferred relay assembly sectioned along the coil assembly axis of rotation.
Figure 15:
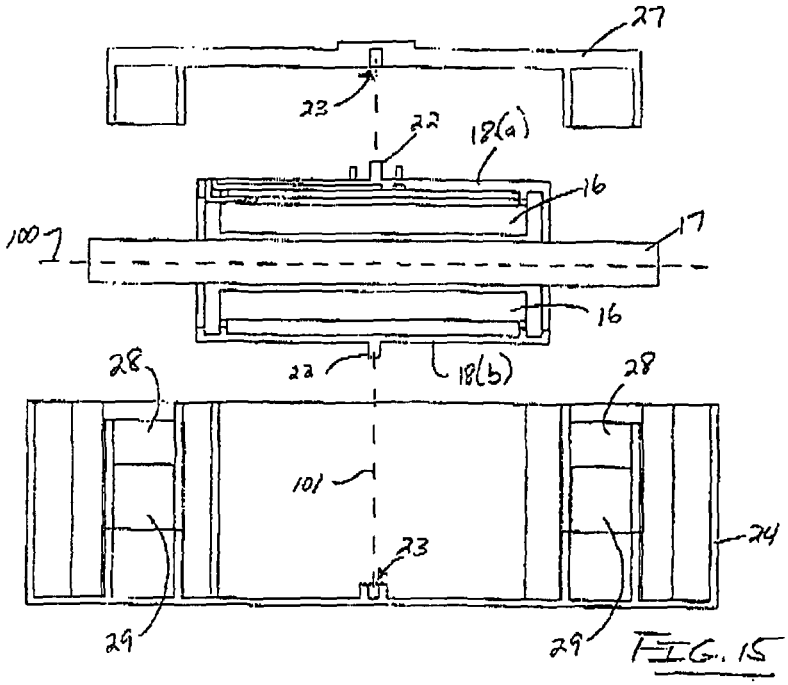
FIG. 15 is a fragmentary exploded sectional view of the structures otherwise depicted in FIG. 14 showing the coil axis orthogonal to the coil assembly axis of rotation.
Figure 16:
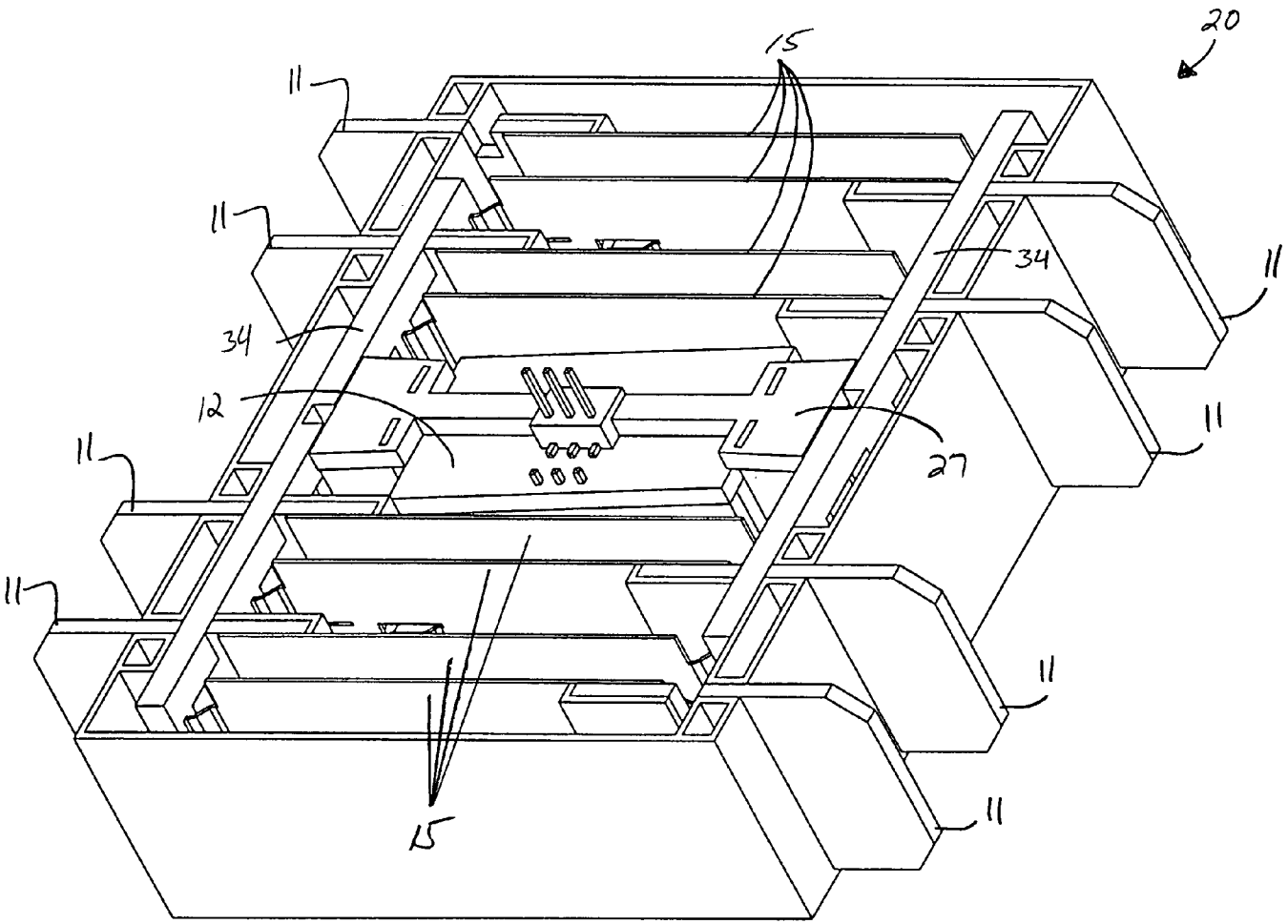
FIG. 16 is top perspective view of an assembled and alternative multi-pole relay assembly according to the present invention with relay housing cover removed to show internal components.
Figure 17:
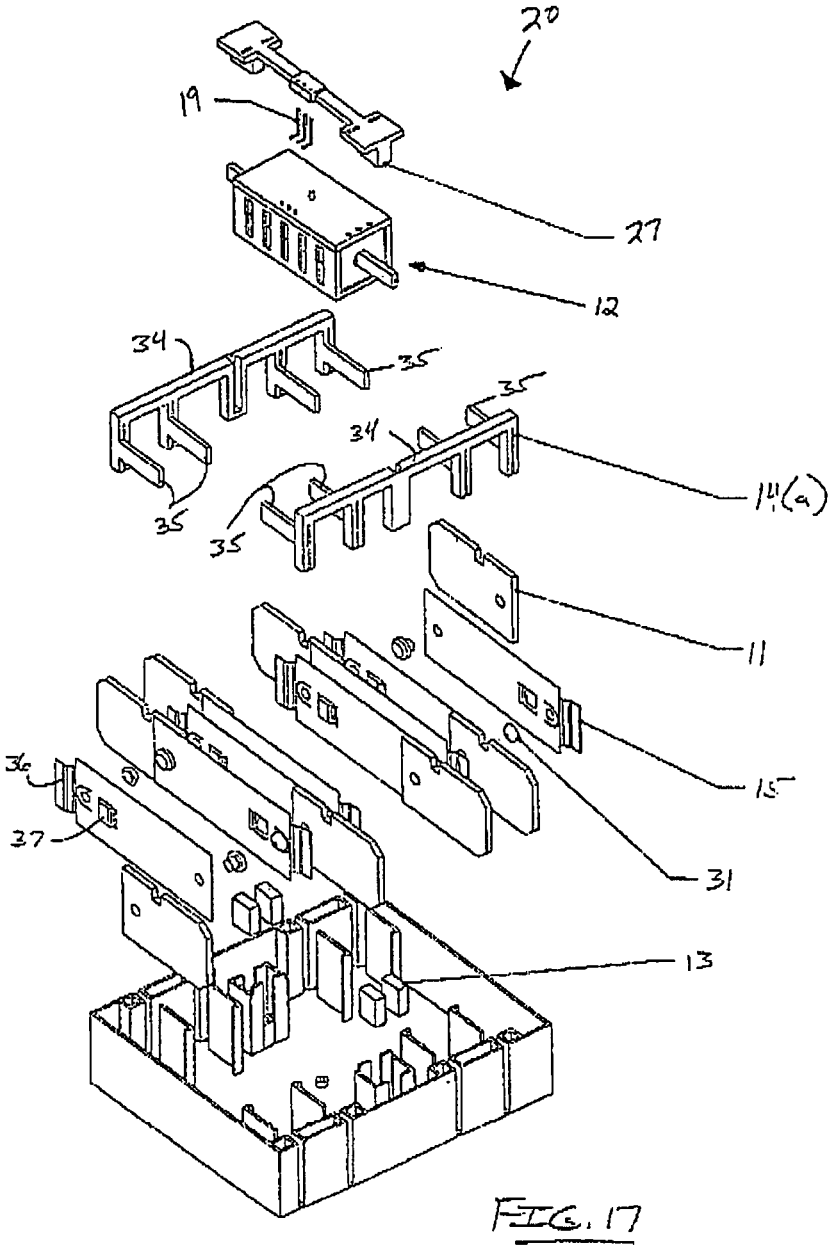
FIG. 17 is an exploded top perspective view of the alternative multi-pole relay assembly according to the present invention showing from top to bottom, a bracket structure, an assembled coil assembly, linkage structures, contact-spring assemblies, permanent magnets, and the relay bottom casing.
Figure 18:
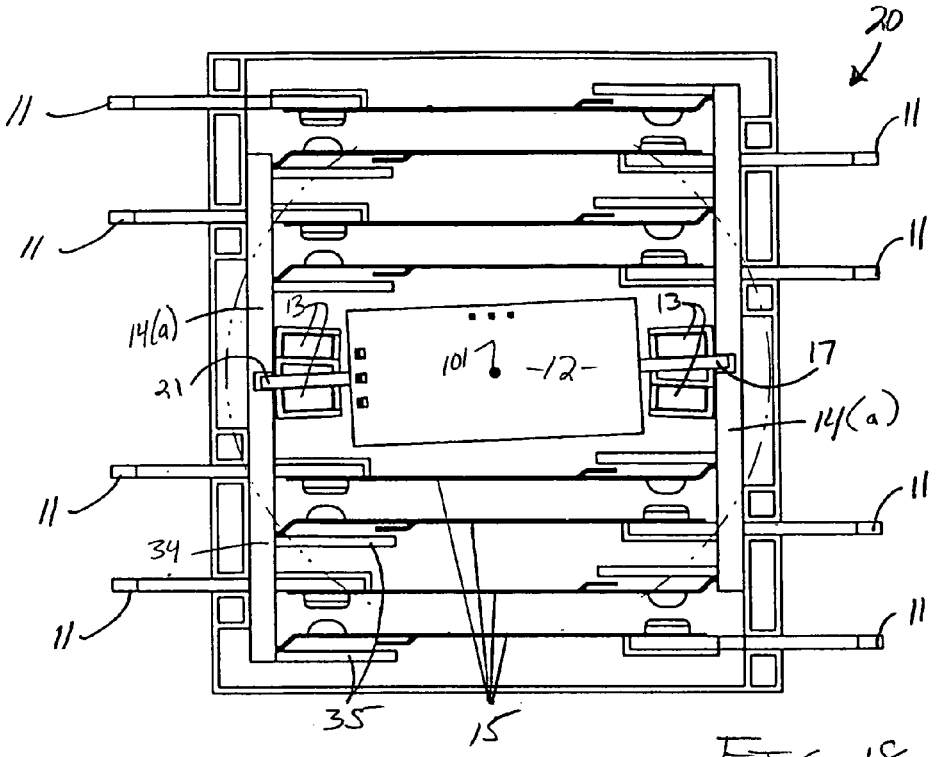
FIG. 18 is top plan view of the assembled and alternative multi-pole relay assembly according to the present invention with relay housing cover removed to show internal components in an open switch assembly position.
Figure 19:
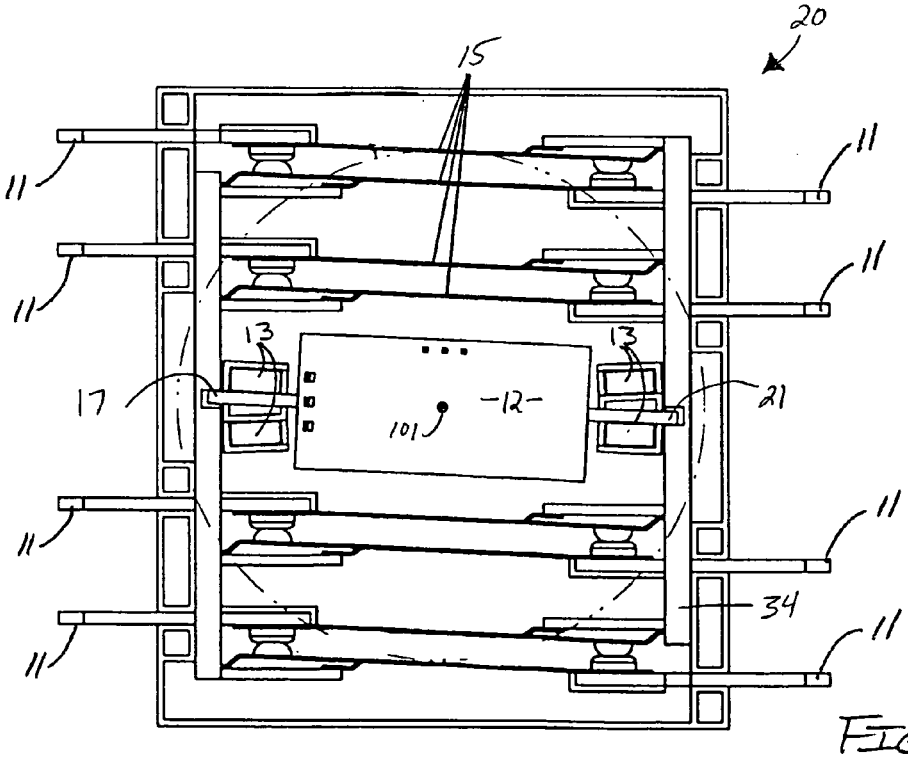
FIG. 19 is top plan view of the assembled and alternative multi-pole relay assembly according to the present invention with relay housing cover removed to show internal components in a closed switch assembly position.
Figure 20:
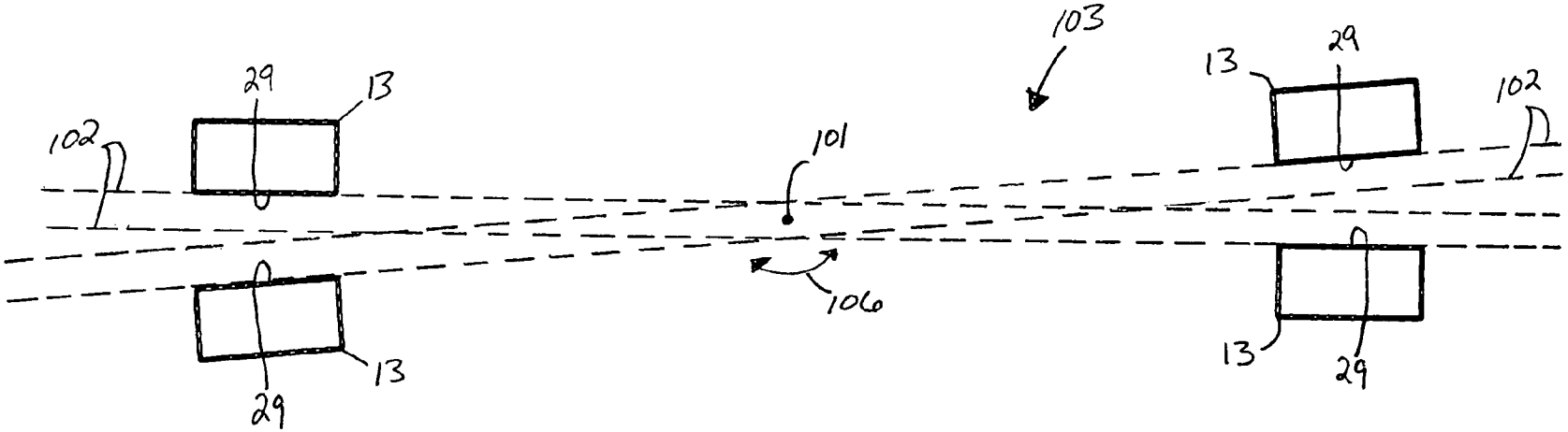
FIG. 20 is a diagrammatic depiction of X-shaped plane boundaries that define the limits of movement of the core termini intermediate the fixedly positioned permanent magnets according to the present invention.

The spring arms 15 are preferably parallel to one another whether in the open or closed switch assembly positions and each comprise opposed faces, the inner faces 40 of which face one another as generally depicted and referenced in FIGS. 10 and 11. The opposed inner faces 40 are magnetically attractive to one another (as generally referenced at 107) during a short circuit scenario, and thus the magnetically attractive faces 40 function to maintain the contacts 31 in the closed switch assembly position during a short circuit scenario.

In this last regard, it is noted that during a short circuit the magnetic fields generated inside a relay will grow as the current increases. The contacts, however, tend to separate during the rush of current. To structurally address this, the present invention enables the manufacturer to form one type of contact-spring assembly, and use the same assembly twice as generally depicted and illustrated by spring arm(s) 15, termini 11, and contacts 31.

It should be noted that half the current will flow through the top contact-spring assembly and half the current will flow through the bottom contact-spring assembly. Since these assemblies are carrying the same current in the same direction, the magnetic forces generated thereby are therefore equal. This means that when the bottom of the top spring is generating a magnetic field with a south polarity, the top of the bottom spring will generate a magnetic field with a north polarity. Since north and south attract one another (as at 107), the attraction forces the contacts 31 into the closed position during a short circuit. The greater the current during the short circuit, the greater will be the magnetic field; therefore, the magnetic attraction 107 to maintain the contacts 31 in a closed position is maximized.

The described contact-spring assembly is similar to existing assemblies insofar as the terminals 11 and spring arms 15 are preferably constructed from copper whereby the spring arm 15 is placed on top of the copper terminal and then riveted together via the contact buttons 31. By arranging the spring arms 15 so that faces 40 oppose one another, a resulting contact system allows for one input from a copper terminal, then splits the load through two springs and outputs the load again on the other copper terminal. Since the two springs (i.e. spring arms 15) are preferably identical in terms of their manufacturability, they will bear a very similar, if not identical, resistance. Furthermore, these two springs are running directly parallel to one another, resulting in the same magnetic fields generated around the spring arms 15.

The spring arms 15 preferably comprise first and second spring portions or means for effecting bi-stability. The first spring portions or means are generally contemplated to be exemplified by resiliently bends in the arms 15 as generally depicted and referenced at 36. The first spring means are preferably relaxed when in an open switch assembly position and preferably actuated when in a closed switch assembly position, but not necessarily so. It is contemplated that the actuated first spring means may well function to dampen contact vibration intermediate the contacts 31 when switching from the open switch assembly position to the closed switch assembly position.

The second spring portions or means are generally contemplated to be exemplified by resilient spring extensions as generally depicted and referenced at 37. The second spring portions or means 37 are preferably relaxed when in an open switch assembly position and preferably actuated when in a closed switch assembly position, but not necessarily so configured. It is contemplated that the actuated second spring means may well function to enhance damped contact vibration intermediate the contacts 31 when switching from the open switch assembly position to the closed switch assembly position.

It should be noted that first spring means are preferably actuable adjacent the first link portions 32 or 34 and that the second spring means are preferably actuable adjacent the second link portions 33 or 35. The first and second spring means thus provide spaced damping means for each contact pair. It is contemplated that the spaced damping means may well function to further enhance damped contact vibration intermediate the contacts 31 when switching from the open switch assembly position to the closed switch assembly position.

In this last regard, it should be further noted that each contact pair is preferably positioned intermediate the spaced first and second damping means, which spaced damping means thus provide laterally opposed damping means relative to each contact pair for still further enhancing damped contact vibration intermediate the contacts 31 when switching from the open switch assembly position to the closed switch assembly position.

As earlier noted, a major problem for all electro-mechanical switchgear is the contact bounce when closing into an electric load. To overcome this, the typical structural remedy is to include additional leaf or coil springs to buffer the bounce of the contacts. The present invention takes advantage of a simple stamping process which enables the incorporation of an integrated bounce reduction spring as exemplified by resilient bends 36 and resilient extensions 37, which structural features are spaced laterally relative to the contacts 31. The present design thus applies contact pressure both the left and right side of the contact, ensuring equal contact pressure and making sure that the contacts stay closed when the relay is operated.

While the above descriptions contain much specificity, this specificity should not be construed as limitations on the scope of the invention, but rather as an exemplification of the invention. For example, the invention may be said to essentially teach or disclose an electromagnetic relay assembly comprising a rotatable coil assembly, opposed pairs of attractive magnets, and a switch assembly.

The coil assembly comprises a coil, a core, and certain core-rotating means as exemplified by the rotatable coil housing with peripheral, pivot type rotation-enabling structures. The core is preferably collinear with or parallel to the axis of the coil and comprises exposed and opposed core termini. Notably, the core-rotating means have an axis of rotation that extends orthogonally relative to the coil axis.

The opposed pairs of attractive magnets are respectively and fixedly positioned adjacent the core termini such that the core termini are respectively displacable intermediate the magnet pairs. The coil function to create a magnetic field directable through the core into opposed magnets for imparting rotation about the axis of rotation. The core termini actuate the switch assembly intermediate an open position and a closed position, the latter of which positions enable current to pass through the switch assembly.

The electromagnetic relay assemblies further comprise certain linkage means and opposed spring assemblies. The linkage means as exemplified by the linkage arms 14 and 14(*a*) interconnect the core termini and spring assemblies. The spring assemblies essentially function to dampen contact vibration when switching from the open position to the closed position. The spring assemblies preferably comprise first and second spring means, which means are preferably relaxed when in the open position and preferably actuated when in the closed position, but the reverse structural configuration, namely that the first and second spring means may be relaxed when in the closed position and actuated when in the open position are also viable alternatives.

The first and second spring means are spaced from one another opposite the contacts for providing spaced, laterally opposed damping means for further enhancing damped contact vibration of the switch assembly when switching from the open to closed positions. The spring arms of the spring assemblies are preferably parallel to one another and comprise opposed arm faces as at 40. The opposed arm faces 40 are magnetically attractive to one another during a short circuit scenario, which magnetically attractive arm faces for maintaining the switch assembly in the closed position during the short circuit scenario.

The attractive magnets comprise opposed magnet faces, which opposed magnet faces are substantially planar and extend in intersecting planes, and the core (termini) have substantially planar opposed core faces. The contacting core faces and magnet faces are similarly angled for maximizing contact surface area for further enhancing current flow through contacting surface area intermediate the core and magnet faces.

In addition to the foregoing structural considerations, it is further believed that the inventive concepts discussed support certain new methodologies and/or processes. In this regard, it is contemplated that the foregoing structure considerations support a method for switching an electromagnetic relay comprising the steps of outfitting a coil assembly with means for rotating the coil assembly about an axis of rotation orthogonal to coil assembly axis whereafter a magnetic field may be created via the coil assembly and directed through the coil assembly into opposed magnets for imparting rotation about the axis of rotation. The coil assembly is then rotated (or pivoted) about the axis of rotation, and the switch assembly is actuated intermediate open and closed positions via the rotating coil assembly.

The method is believed to further comprise the step of damping contact vibration via opposed contact-spring assemblies when displacing the switch assembly from the open to closed position, which may involve the step of laterally spacing the damping means relative to contacts of the switch assembly before the step of damping contact vibration. Certain faces (as at 40) of the contact-spring assemblies may be opposed before the step of damping contact vibration such that the opposed faces are magnetically attractive to one another during a short circuit scenario for maintaining the switch assembly in the closed position during said scenario.

Although the invention has been described by reference to a number of embodiments it is not intended that the novel device or relay be limited thereby, but that modifications thereof are intended to be included as falling within the broad scope and spirit of the foregoing disclosure and the appended drawings. For example, the foregoing specifications support an electromagnetic relay assembly primarily intended for use as a single pole relay assembly as at 10. It is contemplated, however, that the essence of the invention may be applied in multi-pole relay assemblies as generally depicted and referenced by assembly 20, having unique construction and functionality in their own right, but which are enabled by the teachings of the single pole embodiment primarily set forth in this disclosure.

I claim:

1. An electromagnetic relay assembly for selectively enabling current to pass through switch termini, the electromagnetic relay assembly comprising:

a rotatable coil assembly, the rotatable coil assembly comprising a current-conductive coil, a coil core, and a coil housing, the coil housing for enclosing the coil and the core, the coil being wound around the core, the core being collinear with a coil axis, the coil comprising electromagnet-driving termini, the core comprising opposed core termini, the coil housing having an housing axis of rotation orthogonal to the coil axis, the entire coil housing being rotatable about the housing axis of rotation such that the coil housing, and the coil and the core enclosed within the coil housing all rotate when the coil housing rotates about the housing axis of rotation, the coil axis thereby being rotatively displaceable intermediate X-shaped planar boundaries;

first and second magnet pairs of opposed permanent magnets, the magnet pairs being respectively and fixedly positioned adjacent the core termini such that the core termini are respectively displaceable intermediate the magnet pairs; and a switch assembly, the switch assembly comprising first and second linkage arms, and first and second contact-spring assemblies, the linkage arms interconnecting the core termini and contact-spring assemblies, the contact-spring assemblies comprising opposed pairs of contacts, first and second spring arms, and first and second switch terminals, the coil for creating a magnetic field, the magnetic field being directable through the core for imparting coil housing rotation about the housing axis of rotation via directed attraction to select magnets of the magnet pairs, the core termini for displacing linkage arms, the linkage arms actuating the contact-spring assemblies intermediate an open position and a closed position, the closed position for enabling current to pass through the switch assembly via the contacts and the switch terminals.

2. The electromagnetic relay assembly of claim 1 wherein the linkage arms are L-shaped, the L-shaped linkage anus each having first and second link portions, the second link portions extending toward one another orthogonal to the first link portions, the core termini being connected to the first link portions and the spring arms extending substantially parallel to the second link portions when in the open position.

3. The electromagnetic relay assembly of claim 2 wherein the spring arms comprise first spring means, the first spring means for damping contact vibration intermediate the contacts when switching from the open position to the closed position.

4. The electromagnetic relay assembly of claim 3 wherein the spring arms comprise second spring means, the second spring means for enhancing damped contact vibration intermediate the contacts when switching from the open position to the closed position.

5. The electromagnetic relay assembly of claim 4 wherein the first spring means are actuable adjacent the first link portions and the second spring means are actuable adjacent the second link portions, the first and second spring means thus for providing spaced damping means for each contact pair, the spaced damping means for enhancing damped contact vibration intermediate the contacts when switching from the open position to the closed position.

6. The electromagnetic relay assembly of claim 5 wherein each contact pair is positioned intermediate the spaced damping means, the spaced damping means thus providing laterally opposed damping means for each contact pair for enhancing damped contact vibration intermediate the contacts when switching from the open position to the closed position.

7. The electromagnetic relay assembly of claim 1 wherein the spring arms are parallel to one another whether in the open or closed positions and each comprise opposed faces, the opposed faces being magnetically attractive to one another during a short circuit scenario, the magnetically attractive faces for maintaining the contacts in the closed position during a short circuit scenario.

8. The electromagnetic relay assembly of claim 1 wherein the opposed magnets of the magnet pairs each comprise opposed magnet faces, the opposed magnet faces being substantially planar and extending in intersecting planes, the core having substantially planar opposed core faces, the core faces and magnet faces being similarly angled when contacting one another, the similarly angled core and magnet faces for enhancing magnetic flux through contacting surface area intermediate the core and magnets.

9. An electromagnetic relay assembly, the electromagnetic relay assembly comprising;

a coil assembly, the coil assembly comprising a coil, a core, and core-rotating means, the core being collinear with a coil axis, the core comprising opposed core termini, the core-rotating means having an axis of rotation orthogonal to the coil axis, the coil and core both being rotatable about the axis of rotation via the core-rotating means such that both the coil and the core rotate, the coil axis there being rotatively displaceable intermediate X-shaped planar boundaries;

opposed pairs of attractive magnets, the pairs being respectively and fixedly positioned adjacent the core termini, the core termini being respectively displaceable intermediate the pairs; and a switch assembly, the coil for creating a magnetic field, the magnetic field being directable through the core into opposed magnets for imparting rotation about the axis of rotation, the core termini for actuating the switch assembly intermediate an open position and a closed position, the close position for enabling current to pass through the switch assembly.

10. The electromagnetic relay assembly of claim 9 comprising linkage means and opposed contact-spring assemblies, the linkage means interconnecting the core termini and contact-spring assemblies, the contact-spring assemblies for damping contact vibration when switching from the open position to the closed position.

11. The electromagnetic relay assembly of claim 10 wherein the contact-spring assemblies comprise first spring means, the first spring means for damping contact vibration intermediate the contacts when switching from the open position to the closed position.

12. The electromagnetic relay assembly of claim 11 wherein the contact-spring assemblies comprise second spring means, the second spring means for enhancing damped contact vibration intermediate the contacts when switching from the open position to the closed position.

13. The electromagnetic relay assembly of claim 12 wherein the first and second spring means are spaced from one another for providing spaced damping means, the spaced damping means for enhancing damped contact vibration of the switch assembly when switching from the open to closed positions.

14. The electromagnetic relay assembly of claim 13 wherein the switch assembly comprises opposed contact pairs, the contact pairs each being positioned intermediate the spaced damping means, the spaced damping means thus providing laterally opposed damping means for each contact pair for enhancing damped contact vibration intermediate the contact pairs when switching from the open to closed positions.

15. The electromagnetic relay assembly of claim 9 wherein the contact-spring assemblies comprise first and second spring arms, said arms being parallel and comprising opposed arm faces, the opposed arm faces being magnetically attractive to one another during a short circuit scenario, the magnetically attractive arm faces for maintaining the switch assembly in the closed position during the short circuit scenario.

16. The electromagnetic relay assembly of claim 9 wherein the attractive magnets comprise opposed magnet faces, the opposed magnet faces being substantially planar and extending in intersecting planes, the core termini, having substantially planar opposed core faces, the core faces and magnet faces being similarly angled when contacting one another, the similarly angled core and magnet faces for enhancing current flow through contacting surface area intermediate the core and magnet faces.

17. An electromagnetic relay assembly, the electromagnetic relay assembly comprising:

a coil assembly, the coil assembly comprising opposed core termini, a core axis upon which the core termini are coaxially opposed, and an axis of rotation orthogonal to the core axis, the core termini being rotatable about the axis of rotation such that the core axis is rotatively displaceable intermediate X-shaped planar boundaries;

a magnet pair arranged opposite each core terminus, the core termini being respectively displaceable intermediate the pairs via the axis of rotation; and a switch assembly, the coil assembly for creating a magnetic field, the magnetic field being directable through the core termini into opposed magnets for imparting rotation about the axis of rotation, the core termini for actuating the switch assembly intermediate an open position and a closed position.

18. The electromagnetic relay assembly of claim 17 comprising linkage means and opposed contact-spring assemblies, the linkage means interconnecting the core termini and contact-spring assemblies, the contact-spring assemblies for damping contact vibration when switching from the open to closed positions.

19. The electromagnetic relay assembly of claim 18 wherein the contact-spring assemblies each comprise spaced first and second spring means for providing spaced damping means, the spaced damping means for enhancing damped contact vibration of the switch assembly when switching from the open to closed positions.

20. The electromagnetic relay assembly of claim 19 wherein the switch assembly comprises opposed contact pairs, the contact pairs each being positioned intermediate the spaced damping means, the spaced damping means thus providing laterally opposed damping means for each contact pair for enhancing damped contact vibration intermediate the contact pairs when switching from the open to closed positions.

21. The electromagnetic relay assembly of claim 18 wherein the contact-spring assemblies comprise parallel spring arms, the spring arms comprising opposed arm faces, the opposed arm faces being magnetically attractive to one another during a short circuit scenario, the magnetically attractive arm faces for maintaining the switch assembly in the closed position during the short circuit scenario.

22. A method for switching an electromagnetic relay, the method comprising the steps of:

outfitting a coil assembly having a coil assembly axis with means for rotating the entire coil assembly about an axis of rotation, the axis of rotation being orthogonal to the coil assembly axis;

creating a magnetic field via the coil assembly;

directing the magnetic field through the coil assembly into opposed magnets for imparting rotation about the axis of rotation;

rotating the coil assembly about the axis of rotation such that the coil assembly axis is rotatively displaceable intermediate X-shaped planar boundaries; and displacing a switch assembly intermediate open and closed positions via the rotating coil assembly.

23. The method of claim 22 comprising the step of damping contact vibration via opposed contact-spring assemblies when displacing the switch assembly from the open to closed position.

24. The method of claim 23 comprising the step of laterally spacing the damping means relative to contacts of the switch assembly before the step of damping contact vibration.

25. The method of claim 23 comprising the step of opposing faces of the contact-spring assemblies before the step of damping contact vibration, the opposed faces being magnetically attractive to one another during a short circuit scenario, the magnetically attractive arm faces for maintaining the switch assembly in the closed position during said scenario.

* * * * *